US009687095B2

(12) United States Patent
Riggan et al.

(10) Patent No.: US 9,687,095 B2
(45) Date of Patent: Jun. 27, 2017

(54) RECEPTACLE SYSTEM WITH LID ASSEMBLY

(71) Applicants: Mac Riggan, Wenatchee, WA (US); John Scheierl, Blaine, MN (US)

(72) Inventors: Mac Riggan, Wenatchee, WA (US); John Scheierl, Blaine, MN (US)

(73) Assignee: Alta-Fresh LLC, Chelan, WA (US)

( * ) Notice: Subject to any disclaimer, the term of this patent is extended or adjusted under 35 U.S.C. 154(b) by 0 days.

(21) Appl. No.: 14/028,126

(22) Filed: Sep. 16, 2013

(65) Prior Publication Data

US 2014/0203025 A1 Jul. 24, 2014

Related U.S. Application Data

(60) Provisional application No. 61/701,450, filed on Sep. 14, 2012.

(51) Int. Cl.
*A47G 19/30* (2006.01)
*B65D 51/28* (2006.01)

(52) U.S. Cl.
CPC ..... *A47G 19/30* (2013.01); *B65D 51/28* (2013.01); *B65D 51/2807* (2013.01)

(58) Field of Classification Search
CPC ..... A47G 19/30; B65D 51/28; B65D 51/2807
USPC ..... 220/521, 575, 23.83, 212, 212.5, 523, 220/810, 820, 826; 21/521, 575
See application file for complete search history.

(56) References Cited

U.S. PATENT DOCUMENTS

| | | | | |
|---|---|---|---|---|
| 4,074,827 A * | 2/1978 | Labe, III | B65D 51/28 206/217 |
| 4,699,299 A * | 10/1987 | Gach | 222/480 |
| 6,427,864 B1 * | 8/2002 | Asselin | 220/709 |
| 8,708,181 B2 * | 4/2014 | Buck | 220/253 |

* cited by examiner

*Primary Examiner* — J. Gregory Pickett
*Assistant Examiner* — Elizabeth Volz
(74) *Attorney, Agent, or Firm* — Richard T. Black; Foster Pepper PLLC

(57) ABSTRACT

The present invention is generally directed toward receptacle systems and methods of using the same. In one embodiment, the receptacle system includes a cup and a lid assembly. The lid assembly is configured to allow for removal of consumable items such as, but not limited to, fruit, nuts and seafood, while further providing a holding chamber for disposable items such as, but not limited to pits, shells and seeds that are left over from the consumable items. The cup, the lid assembly, or both may be discarded and replaced or re-used. The lid assembly includes at least one barrier surface or wall that provides physical separation between the consumable items and the disposable items.

13 Claims, 3 Drawing Sheets

RECEPTACLE SYSTEM WITH LID ASSEMBLY

PRIORITY CLAIM

The present application claims priority from U.S. Provisional Patent Application No. 61/701,450, filed on Sep. 14, 2012, and the subject matter of which is incorporated herein by reference in its entirety.

FIELD OF THE INVENTION

The present invention generally relates to receptacle systems for holding consumable items and disposable items while keeping them physically separated.

BACKGROUND

Soft seed or pit bearing fruits (such as cherries, apricots, peaches and the like) while popular for their taste, create the problem of disposal of the pit (or stone or seed). As a result of this inconvenience, some consumers opt to not consume the fruit. Similarly, shelled nuts such as peanuts and sunflower seeds present the problem of disposal of the shells.

BRIEF SUMMARY OF THE INVENTION

The present invention is generally directed toward receptacle systems and methods of using the same. In one embodiment, the receptacle system includes a cup and a lid assembly. The lid assembly is configured to allow for removal of consumable items such as, but not limited to, fruit, nuts and seafood, while further providing a holding chamber for disposable items such as, but not limited to pits, shells and seeds that are left over from the consumable items. The cup, the lid assembly, or both may be discarded and replaced or re-used. The lid assembly includes at least one barrier surface or wall that provides physical separation between the consumable items and the disposable items.

In one aspect of the present invention, a receptacle system includes a cup configured to hold consumable items; and a lid assembly having an upper lid and a lower lid that cooperate to provide dispensing of the consumable items from the cup and further provide a holding chamber for disposable items, the lower lid includes a surface and a barrier wall for maintaining the disposable items separate from the consumable items.

In another aspect of the invention, a lid assembly includes an upper lid; and a lower lid that cooperate to provide dispensing of a plurality of consumable items from a receptacle, the upper lid and lower lid form a holding chamber for a plurality of disposable items, the lower lid includes a surface and a barrier wall for maintaining the disposable items separate from the consumable items.

In yet another aspect of the invention, a method for using a receptacle system to hold consumable items and disposable items includes the steps of (1) tipping the receptacle system to permit consumable items to be dispersed from a cup of the receptacle system and further dispersed through first and second apertures of a lid assembly; (2) consuming the consumable items; and (3) expelling disposable items into the lid assembly of the receptacle system through a third aperture of the lid assembly, wherein the lid assembly is configured to provide a holding chamber for the disposable items while further maintaining a physical separation of the disposable items from the consumable items.

BRIEF DESCRIPTION OF THE DRAWINGS

Preferred and alternative embodiments of the present invention are described in detail below with reference to the following drawings.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with receptacles for holding fruits, nuts and other types of food items along with various lids for such receptacles, and including methods of making or using any of the above have not necessarily been shown or described in detail to avoid unnecessarily obscuring descriptions of the embodiments of the invention. For purposes of brevity and clarity, the following description will be directed to a receptacle system for holding cherries and disposing of cherry pits and/or stems, but it is understood that the receptacle system may be used for a wide variety of food items such as, but not limited to, nuts (e.g., pistachios and peanuts), sunflower seeds, other types fruits that have pits and/or stems, and shrimp or other types of peel-able seafood. More generally, the receptacle system may be used for any food that includes a consumable portion and a disposable portion.

Figure 1:
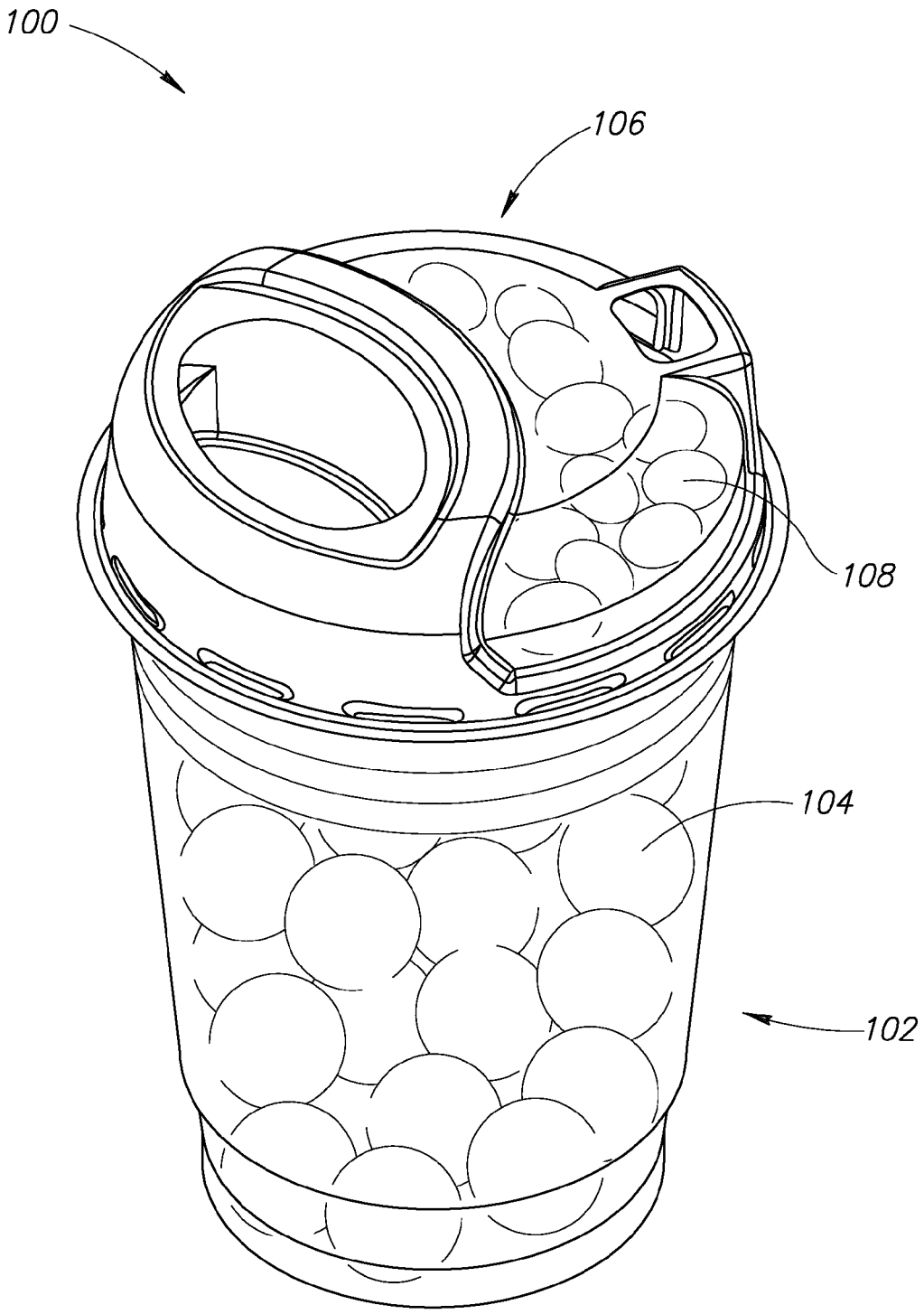
FIG. 1 is a perspective view of a receptacle system having a cup and a lid assembly according to an embodiment of the present invention.

FIG. 1 shows a receptacle system 100 having a cup 102 for receiving a plurality of consumable items (e.g., cherries) 104 and further having a lid assembly 106 configured to receive a plurality of disposable items (e.g., cherry pits) 108 according to an embodiment of the present invention. The lid assembly 106 is configured to receive the disposable items while providing a barrier between the disposable items and the consumable items 104. By way of example, the receptacle system 100 permits users to consume cherries and have a convenient place to temporarily dispose of the cherry pits 108 without having to expel the cherry pits 108 onto the ground or into a trash receptacle. Further, the lid assembly 106 allows for the consumption of the consumable item 104 by tipping the cup 102 to the mouth while any pits 108 remained self contained in the lid assembly 106.

Figure 2A:
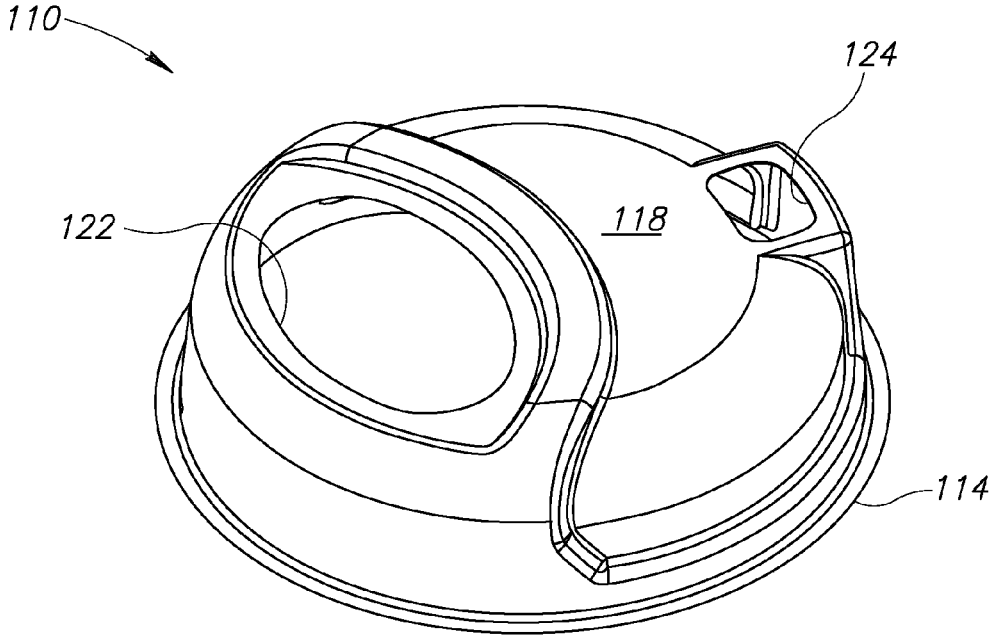
FIG. 2A is a perspective view of an upper lid of the lid assembly of FIG. 1 according to an embodiment of the present invention.
Figure 2B:
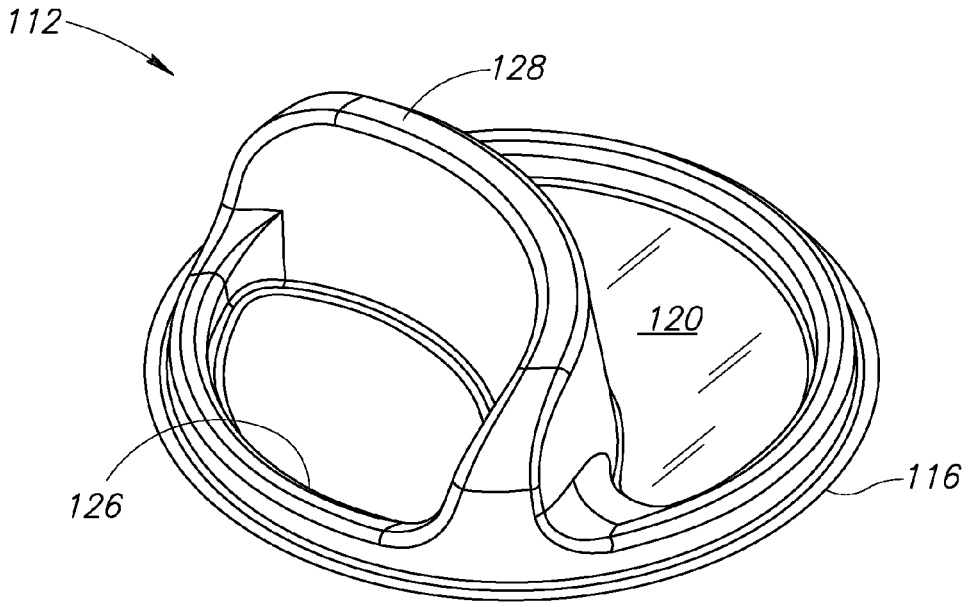
FIG. 2B is a perspective view of a lower lid of the lid assembly of FIG. 1 according to an embodiment of the present invention.

While still referring to FIG. 1, FIGS. 2A and 2B show perspective views of an upper lid 110 and a lower lid 112, respectively, according to an embodiment of the present invention. The upper lid 110 and the lower lid 112 cooperate to form the lid assembly 106.

The upper lid 110 includes a first periphery portion 114 of the upper lid 110 is connectable with a second periphery portion 116 of the lower lid 112. By way of example, the first periphery portion 114 and the second periphery portion 116 may be snap fit together (e.g., slight interference fit), mechanically screwed together or mechanically connected in some other manner. The upper lid 110 includes a dome portion 118 that cooperates with a supporting surface 120 to hold and secure the disposable items 108 within the lid assembly 106, especially when the receptacle system 100 is being tipped. The supporting surface 120 provides the physical separation between the consumable items 104 in the cup 102 and the disposable items 108 that are expelled into the lid assembly 106.

Further, the upper lid 110 includes a first upper lid aperture 122 sized to allow for removal of the consumable items 104. The upper lid 110 further includes a second upper lid aperture 124 sized to receive the disposable items 108. The lower lid 112 includes a first lower lid aperture 126 and a barrier wall 128. The first lower lid aperture 126 is sized to cooperate with the first upper lid aperture 122 to allow for removal of the consumable items 104. The first lower lid aperture 126 and the first upper lid aperture 122 may have the same size and configuration or may be slightly different depending on the application in which the receptacle system 100 is being utilized. By way of example, the size of the first upper lid aperture 122 may be slightly smaller than that of the first lower lid aperture 126 to control the rate at which the consumable items 104 are dispersed from the receptacle system 100. The barrier wall 128 operates to prevent the disposable items 108 from falling into the cup 102. The barrier wall 128 may take a variety of configurations, but is preferably sized and shaped to cooperate with the upper lid 110 in preventing the disposable items 108 from falling into the cup 102.

Figure 3A:
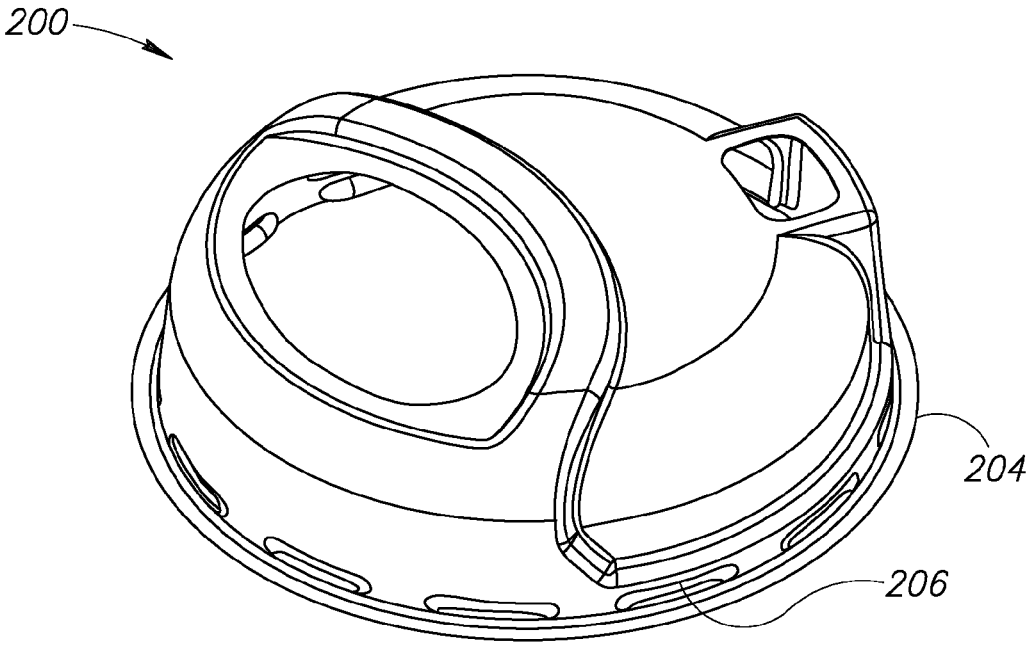
FIG. 3A is an upper lid for a lid assembly according to another embodiment of the present invention.
Figure 3B:
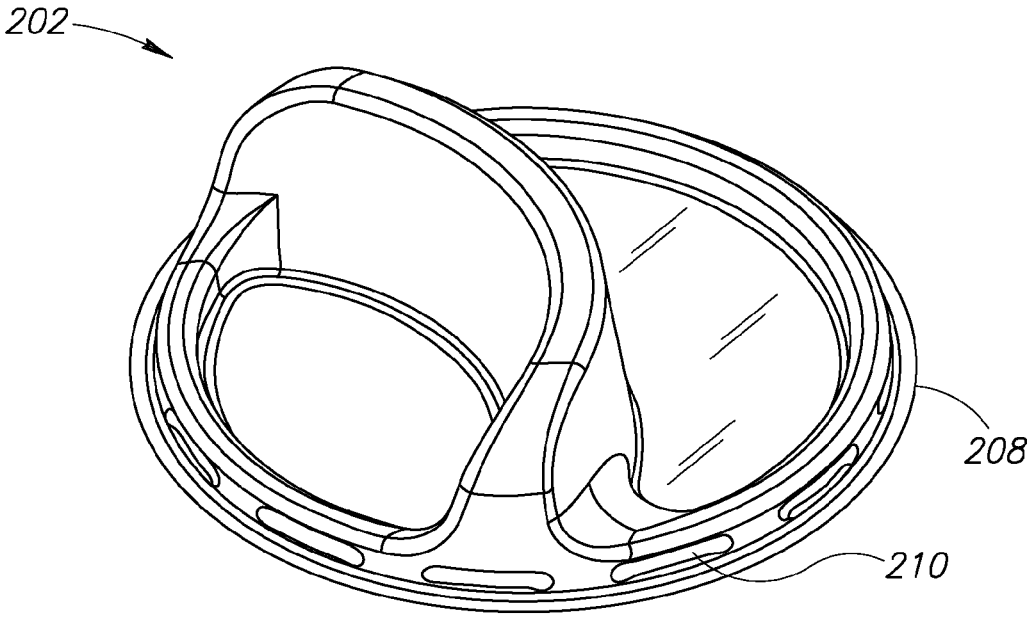
FIG. 3B is a lower lid for a lid assembly according to another embodiment of the present invention.

FIGS. 3A and 3B show another embodiment for an upper lid 200 and a lower lid 202. An upper lid periphery portion 204 includes protuberances 206 that cooperate to couple the upper lid 200 with the lower lid 202. Likewise, an upper lid periphery portion 208 includes detents 210 configured to receive the protuberances 206. In addition, the protuberances 206 and detents 210 may permit the upper lid 200 to be registered with the lower lid 202 so the apertures 122, 126 may be easily aligned. It is appreciated that the protuberances 206 may take the form of detents while the detents 210 may take the form of protuberances.

In operation, a user may tilt the cup 100 and simply tip one or more of the consumable items 104 into their mouth. Once the consumable item 104 has been eaten, the user may rotate the cup 100 and expel the disposable item 108 into the lid assembly 106. Once all the consumable items 104 are gone, or when the lid assembly 106 is full, the user may discard the disposable items 108 and re-use the cup 100. The lid assembly 106 may be discarded or re-used as well. Notably, the user may advantageously accomplish this operation with a single hand without any mess or fuss.

While the preferred embodiment of the invention has been illustrated and described, as noted above, many changes can be made without departing from the spirit and scope of the invention. For example, the preferred lid is for a typically round cup, it could be in any shape. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A receptacle system comprising:

a cup configured to hold consumable items; and a lid assembly comprising an upper lid and a lower lid that cooperate to dispense the consumable items from the cup and provide a holding chamber for disposable items, the lower lid including a surface and a barrier wall configured to maintain the disposable items separate from the consumable items, the lid assembly including an upper lid aperture and the lower lid including a first lower lid aperture, wherein the upper lid and lower lid apertures are not coaxial, the barrier wall only partially circumscribing the lower lid aperture.

2. The receptacle system of claim 1, wherein the upper lid includes a dome portion.

3. The receptacle system of claim 1, wherein the upper lid aperture provides access to the holding chamber and not the cup.

4. The receptacle system of claim 1, wherein the barrier wall is a curved wall.

5. The receptacle system of claim 1, wherein the upper lid is mechanically connectable and removable from the lower lid.

6. A lid assembly comprising:

an upper lid; and a lower lid coupleable to the upper lid, the lid assembly configured to dispense a plurality of consumable items from a receptacle, the upper lid and lower lid, only when coupled together, defining a holding chamber separate from the receptacle, the lower lid including a surface, a barrier wall, and a lower lid aperture, wherein the barrier wall does not fully circumscribe the lower lid aperture, wherein the upper lid includes an upper lid aperture, and wherein the upper lid and lower lid apertures are not coaxial.

7. The lid assembly of claim 6, wherein the upper lid includes a domed portion.

8. The lid assembly of claim 6, wherein the barrier wall includes a curved wall.

9. The lid assembly of claim 6, wherein the upper lid is mechanically connectable and removable from the lower lid.

10. A lid assembly comprising:

an upper lid; and a lower lid coupleable to the upper lid, the lid assembly configured to dispense a plurality of consumable items from a receptacle, the upper lid and lower lid, only when coupled together, defining a holding chamber separate from the receptacle, the lower lid including a surface, a barrier wall, and a lower lid aperture, wherein the barrier wall does not fully circumscribe the lower lid aperture, and wherein the upper lid aperture provides access to the holding chamber and not the receptacle.

11. The lid assembly of claim 10, wherein the upper lid includes a domed portion.

12. The lid assembly of claim 10, wherein the barrier wall includes a curved wall.

13. The lid assembly of claim 10, wherein the upper lid is mechanically connectable and removable from the lower lid.

* * * * *